US010325553B2

(12) United States Patent
Hu

(10) Patent No.: US 10,325,553 B2
(45) Date of Patent: Jun. 18, 2019

(54) PIXEL CIRCUIT AND METHOD FOR DRIVING A LIGHT EMITTING DEVICE AND ORGANIC LIGHT EMITTING DISPLAY PANEL

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventor: Zuquan Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 345 days.

(21) Appl. No.: 14/786,005

(22) PCT Filed: Jan. 12, 2015

(86) PCT No.: PCT/CN2015/070525
§ 371 (c)(1),
(2) Date: Oct. 21, 2015

(87) PCT Pub. No.: WO2016/045256
PCT Pub. Date: Mar. 31, 2016

(65) Prior Publication Data

US 2016/0260377 A1 Sep. 8, 2016

(30) Foreign Application Priority Data

Sep. 25, 2014 (CN) ..... 2014 1 0503599

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01);
(Continued)

(58) Field of Classification Search
CPC ..... G09G 3/3233; G09G 3/3291; G09G 2300/0861; G09G 2300/0842;
(Continued)

(56) References Cited

U.S. PATENT DOCUMENTS 6,525,704 B1 * 2/2003 Kondo ..... G09G 3/3233 315/169.3
2015/0221251 A1 8/2015 Wang
(Continued)

FOREIGN PATENT DOCUMENTS

CN 101986378 A 3/2011
CN 102682704 A 9/2012
(Continued)

OTHER PUBLICATIONS

International Search Report & Written Opinion Appln. No., PCT/CN2015/070525; dated May 4, 2015.
(Continued)

*Primary Examiner* — Kenneth Bukowski
(74) *Attorney, Agent, or Firm* — Ladas & Parry LLP

(57) ABSTRACT

There are provided a pixel circuit, a method for driving the light emitting device (04) and an organic light emitting display panel. The initializing module (03) is added to the pixel circuit. In the initializing phase, the initializing module (03) initializes the driving module (02) and the light emitting device (04); in the writing phase, the charging module (01) writes the data signal inputted from the data signal terminal into the control terminal of the driving module (02); and in the light emitting phase, the charging module (01) loads the first reference signal inputted from the data signal terminal
(Continued)

(Data) to the control terminal of the driving module (02), and the initializing module (03) connects the output terminal of the driving module (02) with the input terminal of the light emitting device (04) so that the driving module (02) drives the light emitting device (04) to emit light. The pixel circuit initializes the driving module (02) and the light emitting device (04) in the initialization phase, which eliminates the influence of the voltage difference in a previous phase on a subsequent phase, provides a compensating voltage and a driving voltage for the driving module (02) in the writing phase, which avoids the influence of change of the threshold voltage on the light emitting luminance of the light emitting device (04), so that the quality of the display picture is ensured.

20 Claims, 4 Drawing Sheets

(52) U.S. Cl.
CPC ..... *G09G 2300/0842* (2013.01); *G09G 2300/0861* (2013.01); *G09G 2310/0251* (2013.01); *G09G 2310/061* (2013.01); *G09G 2310/08* (2013.01); *G09G 2320/0233* (2013.01); *G09G 2320/045* (2013.01)

(58) Field of Classification Search
CPC ..... G09G 2300/0819; G09G 2310/08; G09G 2310/061; G09G 2310/0251; G09G 2320/045; G09G 2320/0233
See application file for complete search history.

(56) References Cited

U.S. PATENT DOCUMENTS

| | | | | |
|---|---|---|---|---|
| 2015/0302798 | A1* | 10/2015 | Tan | G09G 3/3233 345/698 |
| 2016/0132171 | A1* | 5/2016 | Hu | G06F 3/0416 345/174 |

FOREIGN PATENT DOCUMENTS

| | | | |
|---|---|---|---|
| CN | 102832229 | A | 12/2012 |
| CN | 102930813 | A | 2/2013 |
| CN | 102930820 | A | 2/2013 |
| CN | 202838916 | U | 3/2013 |
| CN | 103226931 | A | 7/2013 |
| CN | 103280182 | A | 9/2013 |
| CN | 104269133 | A | 1/2015 |
| KR | 20100069963 | A | 6/2010 |

OTHER PUBLICATIONS

First Chinese Office Action Appln. No. 201410503599.0; dated Jan. 6, 2016.

* cited by examiner

PIXEL CIRCUIT AND METHOD FOR DRIVING A LIGHT EMITTING DEVICE AND ORGANIC LIGHT EMITTING DISPLAY PANEL

TECHNICAL FIELD

The present disclosure relates to a pixel circuit, a method for driving a light emitting device in the pixel circuit and an organic light emitting display panel.

BACKGROUND

With the progress of display technology, an organic light emitting display (OLED) becomes one of hot topics in the research field of flat panel display. More and more active matrix organic light emitting diode (AMOLED) display panels enter into the market. Relative to a traditional thin film transistor liquid crystal display (TFT LCD) panel, AMOLED has a faster response speed, a higher contrast and a broader view angle.

A general AMOLED pixel circuit is of a circuit structure comprising: a driving transistor, a switching transistor, a storage capacitor, and a light emitting device.

Since a threshold voltage of the driving transistor would drift with a long time operation of a display panel and OLED is current-driven, it requires a stable current to control light emitting. However, due to manufacturing process and device aging and so on, non-uniformity exists in a threshold voltage $V_{th}$ of a driving transistor driving OLED, thereby resulting in that a change occurs in the current flowing through OLED of each pixel point such that display luminance is non-uniform, which influences display effect of the entire image.

Therefore, how to reduce the influence of change of the threshold voltage of the driving transistor in the pixel circuit on the light emitting luminance of the light emitting device so as to reduce the influence on display effect of the entire image is a problem to be solved urgently by those skilled in the art.

SUMMARY

There are provided in an embodiment of the present disclosure a pixel circuit, a method for driving a light emitting device in the pixel circuit, and an organic light emitting display panel, which are used to solve the problem existing in the prior art that a change of a threshold voltage of a driving transistor in the pixel circuit influences light emitting luminance of a light emitting device.

There is provided in an embodiment of the present disclosure a pixel circuit, comprising a light emitting device, and further comprising:

a charging module, whose input terminal is connected to a data signal terminal, and control terminal is connected to a scanning signal terminal;

a driving module, whose input terminal is connected to a first reference signal terminal, and control terminal is connected to an output terminal of the charging module; and an initializing module, whose first input terminal is connected to an output terminal of the driving module, first output terminal is connected to an output terminal of the charging module, first control terminal is connected to an initializing signal terminal, second control terminal is connected to a control signal terminal, second output terminal is connected to an input terminal of the light emitting device, and second input terminal is connected to an output terminal of the light emitting device and a second reference signal terminal respectively;

wherein in an initializing phase, the initializing module is configured to initialize the driving module and the light emitting device under the control of the initializing signal terminal and the control signal terminal; in a writing phase, the charging module is configured to write a data signal inputted from the data signal terminal into the control terminal of the driving module under the control of the scanning signal terminal; and in a light emitting phase, the charging module is configured to load a first reference signal inputted from the data signal terminal to the control terminal of the driving module under the control of the scanning signal terminal, and the initializing module is configured to connect the output terminal of the driving module with the input terminal of the light emitting device under the control of the control signal terminal so that the driving module drives the light emitting device to emit light.

In a possible implementation, in the pixel circuit provided in the embodiment of the present disclosure, the driving module can comprise a driving transistor and a storage capacitor, wherein a gate of the driving transistor is connected to the output terminal of the charging module and the first output terminal of the initializing module, a source thereof is connected to the first reference signal terminal, and a drain thereof is connected to the first input terminal of the initializing module; and the storage capacitor is connected between the gate and the drain of the driving transistor.

In a possible implementation, in the pixel circuit provided in the embodiment of the present disclosure, the initializing module can comprise a reset unit and a control unit; wherein a control terminal of the reset unit is connected to the initializing signal terminal, a first output terminal thereof is connected to the output terminal of the charging module and the gate of the driving transistor respectively, a first input terminal thereof is connected to the drain of the driving transistor and an output terminal of the control unit respectively, a second output terminal thereof is connected to an input terminal of the control terminal and the input terminal of the light emitting device, and a second input terminal thereof is connected to the output terminal of the light emitting device and the second reference signal terminal;

a control terminal of the control unit is connected to the control signal terminal;

in the initializing phase, the reset unit connects the gate and the drain of the driving transistor under the control of the initialization signal terminal, and connects the input terminal of the light emitting device with the second reference signal terminal; the control unit connects the drain of the driving transistor with the second output terminal of the reset unit under the control of the control signal terminal; and in the light emitting phase, the control unit connects the drain of the driving transistor with the input terminal of the light emitting device under the control of the control signal terminal.

In a possible implementation, in the pixel circuit provided in the embodiment of the present disclosure, the reset unit can comprise a first switching transistor and a second switching transistor; wherein, a gate of the first switching transistor is connected to the initializing signal terminal, a drain thereof is connected to the output terminal of the charging module and the control terminal of the driving transistor respectively, and a source thereof is connected to the drain of the driving transistor and the output terminal of the control unit respectively; and a gate of the second switching transistor is connected to the initializing signal terminal, a drain thereof is connected to the input terminal of the control unit and the input terminal of the light emitting device respectively, and a source thereof is connected to the output terminal of the light emitting device and the second reference signal terminal respectively.

In a possible implementation, in the pixel circuit provided in the embodiment of the present disclosure , the control unit can comprise a third switching transistor; and a gate of the third switching transistor is connected to the control signal terminal, a drain thereof is connected to the drain of the driving transistor and the source of the first switching transistor respectively, and a source thereof is connected to the drain of the second switching transistor and the input terminal of the light emitting device.

In a possible implementation, in the pixel circuit provided in the embodiment of the present disclosure, the charging module can comprise a fourth switching transistor;

a gate of the fourth switching transistor is connected to the scanning signal terminal, a source thereof is connected to the data signal terminal, and a drain thereof is connected to the drain of the first switching transistor and the gate of the driving transistor respectively.

In a possible implementation, in the pixel circuit provided in the embodiment of the present disclosure, in the writing phase, the charging module can be configured to write a threshold voltage of the driving transistor into the storage capacitor before writing the data signal into the control terminal of the driving module.

Further, there is provided in an embodiment of the present disclosure an organic light emitting display panel, comprising the pixel circuit provided in the embodiment of the present disclosure.

Further, there is provided in an embodiment of the present disclosure a method for driving a light emitting device in a pixel circuit including a charging module, a driving module, an initializing module and the light emitting device, comprising following steps:

in an initializing phase, initializing the driving module and the light emitting device by the initializing module under the control of an initialization signal terminal and a control signal terminal;

in a writing phase, writing a data signal inputted from a data signal terminal by the charging module into a control terminal of the driving module under the control of a scanning signal terminal; and in a light emitting phase, loading a first reference signal inputted from the data signal terminal by the charging module to the control terminal of the driving module under the control of the scanning signal terminal, and connecting an output terminal of the driving module with an input terminal of the light emitting device by the initializing module under the control of the control signal terminal.

DETAILED DESCRIPTION

Specific implementations of a pixel circuit and an organic light emitting display panel provided in embodiments of the present disclosure will be described below in detail by combining with accompanying figures.

Figure 1:
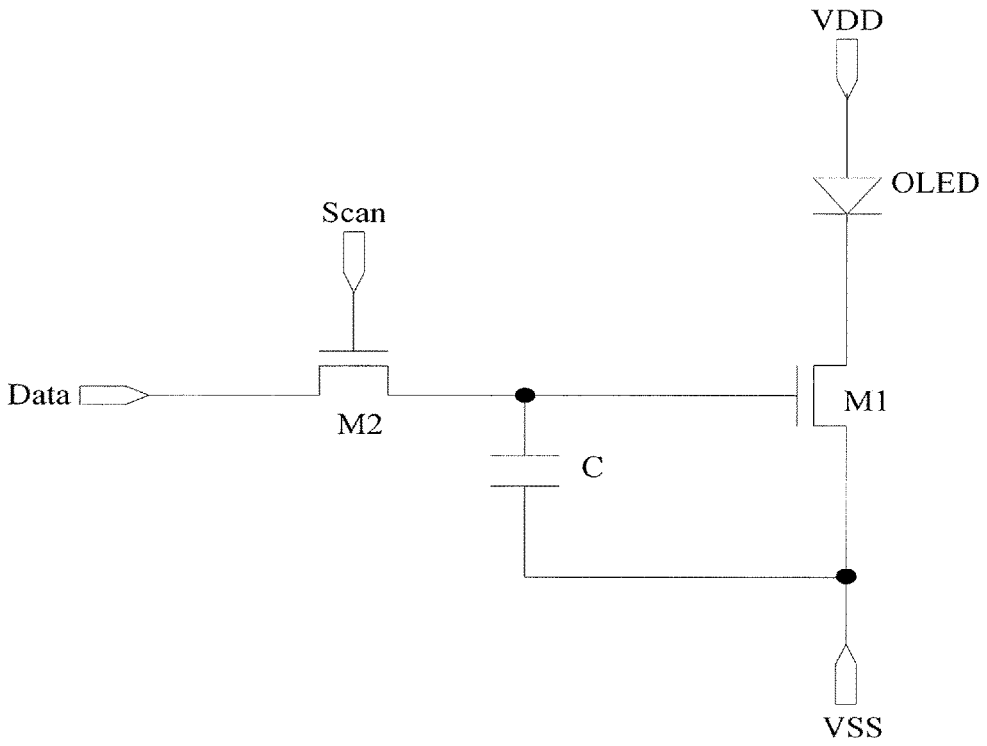
FIG. 1 is a schematic diagram of configuration of a general pixel circuit.

FIG. 1 shows circuit configuration of a general AMOLED pixel circuit. A shown in FIG. 1, the AMOLED pixel circuit comprises: a driving transistor M1, a switching transistor M2, a storage capacitor C, and a light emitting device OLED; wherein a gate of the driving transistor M1 is connected to a drain of the switching transistor M2 and one terminal of the storage capacitor C, a source thereof is connected to one terminal of the light emitting device, and a drain thereof is connected to the other terminal of the storage capacitor C and a first reference signal terminal VSS respectively; a gate of the switching transistor M2 is connected to a scanning signal input terminal Scan, and a source thereof is connected to a data signal terminal Data; and the other terminal of the light emitting device is connected to a second reference signal terminal VDD.

Figure 2:
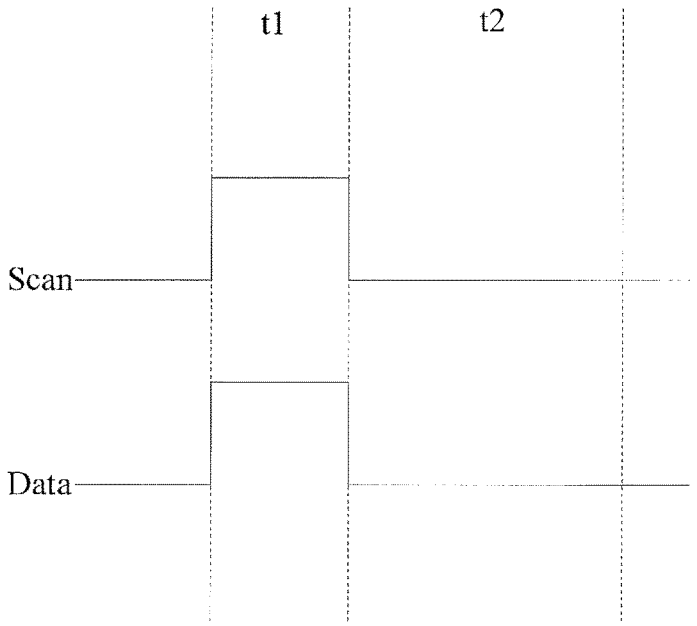
FIG. 2 is an operation timing diagram of the pixel circuit as shown in FIG. 1.

FIG. 2 is an operating timing diagram of the pixel circuit as shown in FIG. 1. It can be known from FIG. 2 that, during a period of time t1, a high level signal is inputted to the scanning signal input terminal Scan, and thus the switching transistor M2 is turned on, now a signal of the data signal terminal Data is written into the storage capacitor C and the gate of the driving transistor M1, so that the driving transistor M1 is turned on and the light emitting device starts to operate and emit light; during a period of time t2, a low level signal is inputted to the scanning signal input terminal Scan, and thus the switching transistor M2 is turned off, now due to discharging effect of the storage capacitor C, the gate of the driving transistor M1 would be maintained in a high level state, the driving transistor M1 is turned on continuously, and OLED would operate and emit light continuously.

Figure 3:
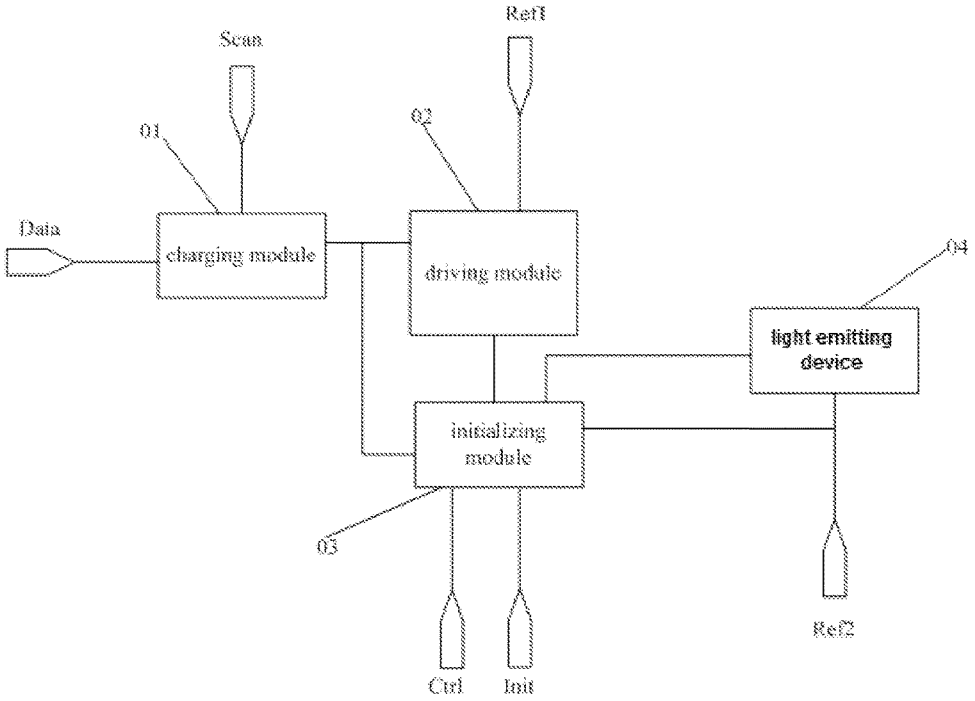
FIG. 3 is a schematic diagram of configuration of a pixel circuit provided in an embodiment of the present disclosure.

FIG. 3 shows a schematic diagram of configuration of a pixel circuit provided in an embodiment of the present disclosure. As shown in FIG. 3, the pixel circuit comprises: a charging module 01, a driving module 02, an initializing module 03, and a light emitting device 04.

In the circuit as shown in FIG. 3, an input terminal of the charging module 01 is connected to the data signal terminal Data, a control terminal thereof is connected to the scanning signal terminal Scan, and an output terminal thereof is connected to a control terminal of the driving module 02 and a first output terminal of the initializing module 03;

an input terminal of the driving module 02 is connected to a first reference signal terminal Ref1, and an output terminal thereof is connected to a first input terminal of the initializing module 03;

a first control terminal of the initializing, module 03 is connected to an initializing signal terminal Init, a second control terminal thereof is connected to a control signal terminal Ctrl, a second output terminal is connected to an input terminal of the light emitting device 04, and a second input terminal is connected to an output terminal of the light emitting device 04 and the second reference signal terminal Ref2 respectively.

In an initializing phase, the initializing module 03 initializes the driving module 02 and the light emitting device 04 under the control of the initializing signal terminal Init and the control signal terminal Ctrl; in a writing phase, the charging module 01 writes a data signal inputted from the data signal terminal Data into the control terminal of the driving module 02 under the control of the scanning signal terminal Scan; and in a light emitting phase, the charging module 01 loads the first reference signal inputted from the data signal terminal Data to the control terminal of the driving module 02 under the control of the scanning signal terminal Scan, and the initializing module 03 connects the output terminal of the driving module 02 with the input terminal of the light emitting device 04 under the control of the control signal terminal Ctrl so that the driving module 02 drives the light emitting device 04 to emit light.

In the pixel circuit provided in the embodiment of the present disclosure, the initializing module 03 is added. In the initializing phase, the initializing module 03 initializes the driving module 02 and the light emitting device 04 under the control of the initializing signal terminal Init and the control signal terminal Ctrl; in the writing phase, the charging module 01 writes the data signal inputted from the data signal terminal Data into the control terminal of the driving module 02 under the control of the scanning signal terminal Scan; and in the light emitting phase, the charging module 01 loads the first reference signal inputted from the data signal terminal Data to the control terminal of the driving module 02 under the control of the scanning signal terminal Scan, and the initializing module 03 connects the output terminal of the driving module 02 with the input terminal of the light emitting device 04 under the control of the control signal terminal Ctrl so that the driving module 02 drives the light emitting device 04 to emit light, thereby realizing the function of normal light emitting of the light emitting device 04. As compared with the pixel circuit in the prior art, the pixel circuit provided in the embodiment of the present disclosure is capable of initializing the driving module 02 and the light emitting device 04 in the initializing phase, which eliminates the influence of a voltage difference in a previous phase on a subsequent phase, providing a compensation voltage and a driving voltage for the driving module 02 in the writing phase, which avoids the influence of change of the threshold voltage on the light emitting luminance of the light emitting device 04, and raises uniformity of the light emitting luminance of the light emitting device 04, so that the quality of the display picture is ensured.

Figure 4:
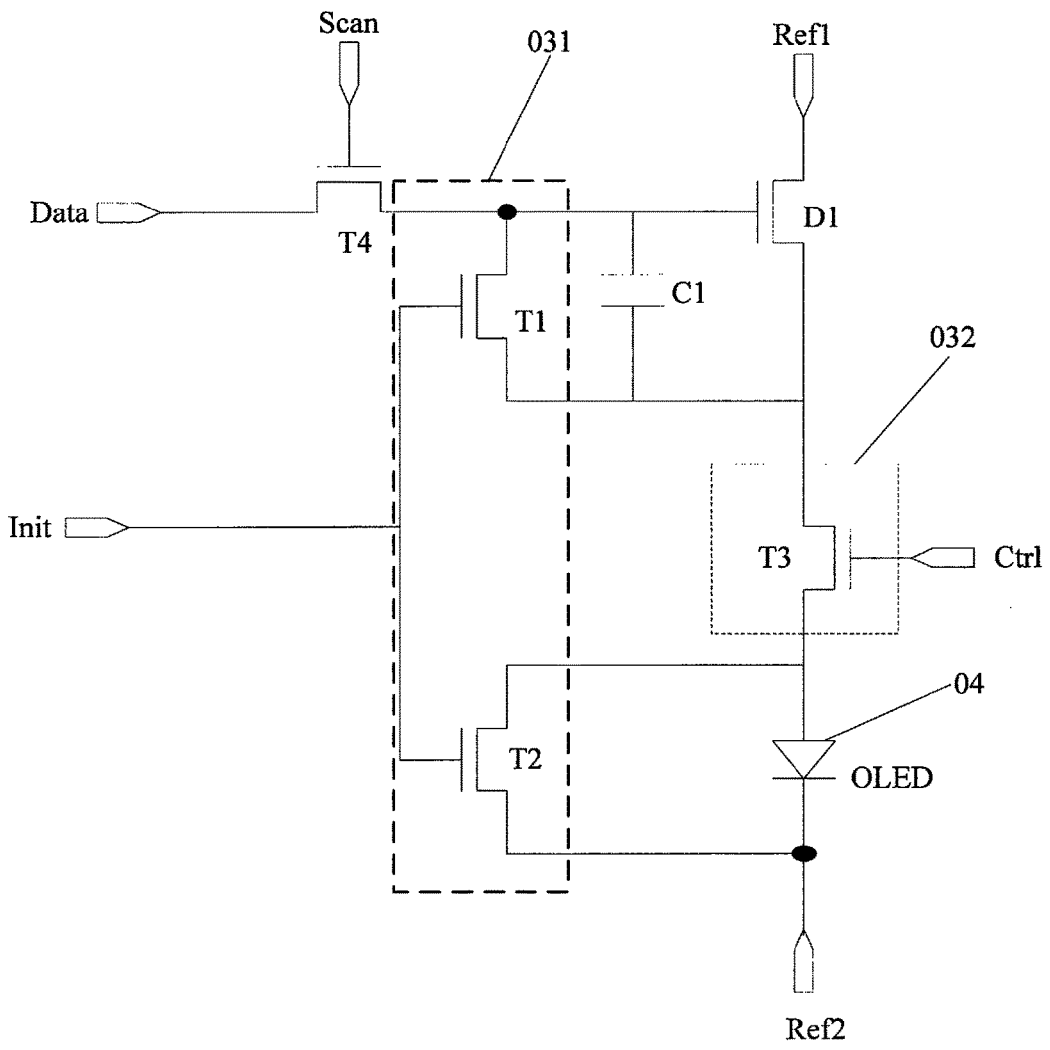
FIG. 4 is a schematic diagram of specific configuration of a pixel circuit provided in an embodiment of the present disclosure.

FIG. 4 shows a schematic diagram of exemplary configuration of a pixel circuit provided in an embodiment of the present disclosure. As shown in FIG. 4, in the pixel circuit provided in the embodiment of the present disclosure, the driving module 02 can comprise a driving transistor D1 and a storage capacitor C1.

In this case, a gate of the driving transistor D1 is connected to the output terminal of the charging module 01 and the first output terminal of the initializing module 03, a source thereof is connected to the first reference signal terminal Ref1, and a drain thereof is connected to the first input terminal of the initializing module 03; and the storage capacitor C1 is connected between the gate and the drain of the driving transistor D1.

Specifically, in the pixel circuit provided in the embodiment of the present disclosure, the driving transistor D1 can be an N type transistor or a P type transistor, which is not limited thereto. In the initializing phase, the initializing module 03 connects the gate of the driving transistor D1 with the drain thereof under the control of the initializing signal terminal Init and the control signal terminal Ctrl, and also connects the drain of the driving transistor D1 with the second reference signal terminal Ref2, so that the net charge across the storage capacitor C1 is zero and at the same time the two terminals of the light emitting device 04 are shorted, so that the light emitting device 04 is in a non light emitting state, which eliminates the influence of the voltage difference of the storage capacitor C1 in the previous phase on the subsequent phase and meanwhile provides time for the process of restoring the threshold voltage of the driving transistor D1.

In the pixel circuit provided in the embodiment of the present disclosure, in order to avoid that the data signal written in the writing phase is insufficient to turn on the driving transistor D1, in the writing phase, the charging module 01 can further be configured to write the threshold voltage of the driving transistor D1 into the storage capacitor C1 before writing the data signal into the control terminal of the driving module 02, that is, in the writing phase, the charging module 01 writes a signal inputted from the data signal terminal Data and being greater than the gate turn-on voltage of the driving transistor D1 into one terminal of the storage capacitor C1, i.e., the gate of the driving transistor D1. Now, the gate of the driving transistor D1 is turned on to charge the other terminal of the storage capacitor C1 until the voltage difference across the storage capacitor C1 is the threshold voltage Vth of the driving transistor D1. Then, the threshold voltage of the driving transistor D1 is stored in the storage capacitor C1, and thus the threshold voltage of the driving transistor D1 is offset.

Exemplarily, in the pixel circuit provided in the embodiment of the present disclosure, as shown in FIG. 4, the initializing module 04 can comprise a reset unit 031 and a control unit 032.

In this case, a control terminal of the reset unit 031 is connected to the initializing signal terminal Init, a first output terminal thereof is connected to the output terminal of the charging module 01 and the gate of the driving transistor D1 respectively, a first input terminal thereof is connected to the drain of the driving transistor D1 and an output terminal of the control unit 032 respectively, a second output terminal thereof is connected to an input terminal of the control terminal 032 and the input terminal of the light emitting device 04, and a second input terminal thereof is connected to the output terminal of the light emitting device 04 and the second reference signal terminal Ref2; a control terminal of the control unit 032 is connected to the control signal terminal Ctrl.

In the initializing phase, the reset unit 031 connects the gate of the driving transistor D1 with the drain thereof under the control of the initialization signal terminal Init, and connects the input terminal of the light emitting device 04 with the second reference signal terminal Ref2; the control unit 032 connects the drain of the driving transistor D1 with the second output terminal of the reset unit 031 under the control of the control signal terminal Ctrl, so that the net charge across the two terminals of the storage capacitor C1 is zero, i.e., eliminating the voltage difference of the storage capacitor C1 in the precious phase on the subsequent phase and meanwhile providing time for the process of restoring the threshold voltage of the driving transistor D1; in the light emitting phase, the control unit 032 connects the drain of the driving transistor D1 with the input terminal of the light emitting device 04 under the control of the control signal terminal Ctrl, so that the driving transistor D1 drives the light emitting device 04 to emit light normally under the control of the driving voltage.

Exemplarily, in the pixel circuit provided in the embodiment of the present disclosure, as shown in FIG. 4, the reset unit 031 can comprise a first switching transistor T1 and a second switching transistor T2.

In this case, a gate of the first switching transistor T1 is connected to the initializing signal terminal Init, a drain thereof is connected to the output terminal of the charging module 01 and the control terminal of the driving transistor D1 respectively, and a source thereof is connected to the drain of the driving transistor D1 and the output terminal of the control unit 032 respectively; and a gate of the second switching transistor T2 is connected to the initializing signal terminal Init, a drain thereof is connected to the input terminal of the control unit 032 and the input terminal of the light emitting device 04 respectively, and a source thereof is connected to the output terminal of the light emitting device 04 and the second reference signal terminal Ref2 respectively.

Specifically, in the pixel circuit provided in the embodiment of the present disclosure, the first switching transistor T1 and the second switching transistor T2 can be N type transistors simultaneously or be P type transistors simultaneously, which is not limited thereto. In the initializing phase, the first switching transistor T1 and the second switching transistor T2 are turned on under the control of the initializing signal terminal Init, the turned on first switching transistor T1 turns on the gate and drain of the driving transistor DI, and the turned on second switching transistor T2 shorts the two terminals of the light emitting device 04, so that the light emitting device is in the non light emitting state.

Exemplarily, in the pixel circuit provided in the embodiment of the present disclosure, as shown in FIG. 4, the control unit 032 can comprise a third switching transistor T3. A gate of the third switching transistor T3 is connected to the control signal terminal Ctrl, a drain thereof is connected to the drain of the driving transistor D1 and the source of the first switching transistor T1 respectively, and a source thereof is connected to the drain of the second switching transistor T2 and the input terminal of the light emitting device 04.

Specifically, in the pixel circuit provided in the embodiment of the present disclosure, the third switching transistor T3 can be the N type transistor or be the P type transistor, which is not limited thereto. In the initializing phase, the third switching transistor T3 is turned on under the control of the control signal terminal Ctrl, and the turned on third switching transistor T3 connects the drain of the driving transistor D1 with the input terminal of the light emitting device 04, and then the drain of the driving transistor D1 is connected with the second reference signal terminal Ref2 through the second switching transistor T2; in the light emitting phase, the third switching transistor T3 is turned on under the control of the control signal terminal Ctrl, and the turned on third switching transistor T3 connects the drain of the driving transistor D1 with the input terminal of the light emitting device 04, so that the driving transistor D1 drives the light emitting device 04 to emit light.

Exemplarily, in the pixel circuit provided in the embodiment of the present disclosure, as shown in FIG. 4, the charging module 01 can comprise a fourth switching transistor T4. A gate of the fourth switching transistor T4 is connected to the scanning signal terminal Scan, a source thereof is connected to the data signal terminal Data, and a drain thereof is connected to the drain of the first switching transistor T1 and the gate of the driving transistor D1 respectively.

Specifically, in the pixel circuit provided in the embodiment of the present disclosure, the fourth switching transistor T4 can be the N type transistor or be the P type transistor, which is not limited thereto. In the writing phase, the fourth switching transistor T4 is turned on under the control of the scanning signal terminal Scan, the turned on fourth switching transistor T4 connects the data signal terminal Data with the gate of the driving transistor D1, writes the data signal of the data signal terminal Data into the gate of the driving transistor D1, and at the same time charges the storage capacitor C1, i.e., storing the threshold voltage of the driving transistor into the storage capacitor C1; in the light emitting phase, also, the turned on fourth switching transistor T4 connects the data signal terminal Data with the gate of the driving transistor D1, so that the first reference signal VDD inputted from the data signal terminal Data is loaded to the gate of the driving transistor DI as a driving voltage of the driving transistor D1 to drive the light emitting device 04 to emit light.

It should be noted that the switching transistors and the driving transistor mentioned in the embodiments of the present disclosure can be thin film transistors (TFT), or can be a metal oxide semiconductors (MOS), which is not limited thereto. In a specific implementation, sources and drains of these transistors can be exchanged with each other and no specific distinction is made to these sources and drains. The specific embodiments are described by taking the thin film transistor as an example.

Figure 5:
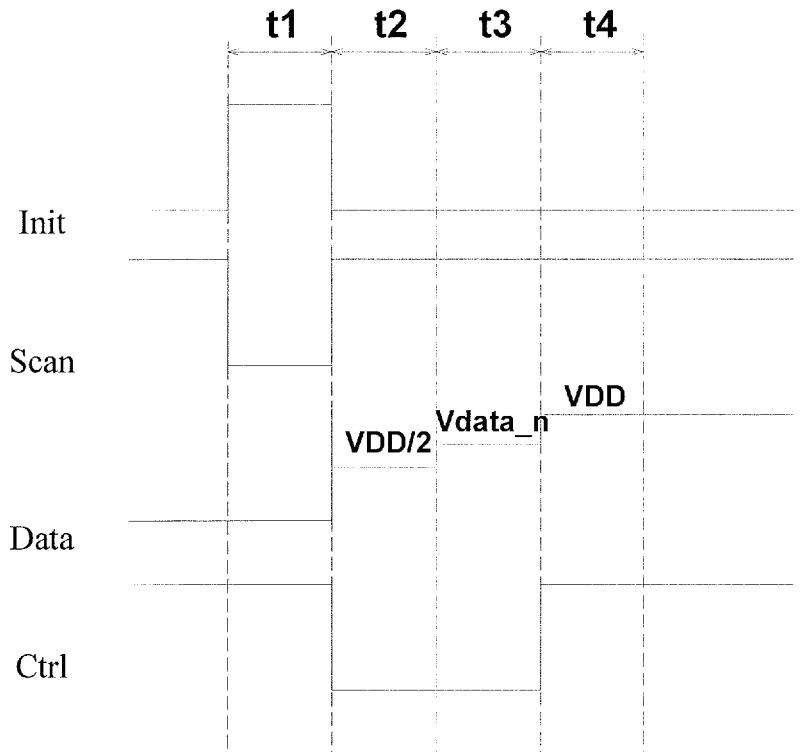
FIG. 5 is an operation timing diagram of the pixel circuit as shown in FIG. 4 provided in an embodiment of the present disclosure.

There will be described below in detail operating processes of the pixel circuit provided in the embodiments of the present disclosure in connection with the pixel circuits provided in the embodiments of the present disclosure as well as operation timings. FIG. 5 schematically shows an operation timing diagram of the pixel circuit provided in the embodiment of the present disclosure as shown in FIG. 4. The operating processes of the pixel circuits provided in the embodiments of the present disclosure are described by using the pixel circuit designed with the N type transistors as shown in FIG. 4 we well as the input and output timing diagrams of FIG. 4 as shown in FIG. 5. Specifically, four periods of time t1-t4 in the input and output timing diagrams as shown in FIG. 5 are selected. In the following description, 1 represents a high level signal, and 0 represents a low level signal.

During the period of time t1, Init=1, Ctrl=1, Scan=0, Ref1=1, and Ref2=0. Since Init=1 and Ctrl=1, the first switching transistor T1, the second switching transistor T2 and the third switching transistors T3 are turned on. Since Scan=0, the fourth switching transistor T4 is turned off. The turned on first switching transistor T1 connects the gate and drain of the driving transistor D1, the turned on third switching transistor T3 connects the drain of the driving transistor D1 with the input terminal of the light emitting device 04, and the turned on second switching transistor T2 shorts the two terminals of the light emitting 04, so that the light emitting device 04 is in the non light emitting state, and at the same time, the drain of the driving transistor D1 is connected with the second reference signal terminal Ref2, and the net charge across the storage capacitor C1 is zero clearing. The t1 phase is the initializing phase.

During the period of time t2, Init=0, Ctrl=0, Scan=1, Ref1=1, and Ref232 0. Since Init=0 and Ctrl=0, the first switching transistor T1, the second switching transistor T2 and the third switching transistors T3 are turned off, and the light emitting device 04 is still in the non light emitting state; since Scan=1, the fourth switching transistor T4 is turned on, the turned on fourth switching transistor T4 connects the data signal terminal Data with the gate of the driving transistor D1, and the data signal inputted from the data signal terminal Data is written into one terminal of the storage capacitor C1. Now, the data signal inputted from the data signal terminal Data is greater than a voltage signal for turning on the gate of the driving transistor D1, for example, a half of the first reference signal VDD. Since the data signal written into one terminal of the storage capacitor C1, i.e., the gate of the driving transistor D1, is VDD/2, the gate of the driving transistor D1 is turned on to charge the other terminal of the storage capacitor C1, through the adjusting of the turning-on of the driving transistor DI, until the voltage of the other terminal of the storage capacitor C1 is VDD/2-Vth, where Vth is the threshold voltage of the driving transistor D1. At this time, the driving transistor DI is in a critical turn-on state, and the threshold voltage Vth is stored in the storage capacitor C1. The t2 phase is the compensating phase.

During the period of time t3, Init=0, Ctrl=0, Scan=1, Ref1=1, and Ref232 0. Since Init=0 and Ctrl=0, the first switching transistor T1, the second switching transistor T2 and the third switching transistors T3 are turned off, and the light emitting device 04 is still in the non light emitting state; since Scan=1, the fourth switching transistor T4 is turned on, the turned on fourth switching transistor T4 connects the data signal terminal Data with the gate of the driving transistor D1, and the data signal Vdata_n inputted from the data signal terminal Data is written into one terminal of the storage capacitor C1, i.e., the gate of the driving transistor D1. Now, the other terminal of the storage capacitor C1 is Vdata_n-Vth, the driving transistor D1 is still in the critical turning-on state, and meanwhile the threshold voltage Vth of the driving transistor D1 is stored in the storage capacitor C1 continuously. The phase t3 is the writing phase of the data signal.

During the period of time t4, Ctrl=1, Scan=1, Ref1=1, and Ref232 0. Since Init=0, the first switching transistor T1 and the second switching transistor T2 are turned off; since Ctrl=1, the third switching transistor T3 is turned on; since Scan=1, the fourth switching transistor T4 is turned on, and the turned on fourth switching transistor T4 connects the data signal terminal Data with the gate of the driving transistor D1. Now, the data signal inputted from the data signal terminal Data is the first reference signal VDD, and is written into the gate of the driving transistor D1 through the turned on fourth switching transistor T4 to control the driving transistor DI turned on and drive the light emitting device 04 to emit light. The phase t4 is the light emitting phase.

At the moment of the driving transistor D1 being turned on, the voltage at the other terminal of the storage capacitor C1 is Vdata n-Vth, and thus the turn-on current of the light emitting device 04 is: $I=K(Vgs-Vth)^2=K(VDD-(Vdata_n-Vth)-Vth)^2=K(VDD-Vdata_n)^2$, where K is a constant related with process parameters and geometric dimensions of the driving transistor D1, Vgs is a voltage difference between the gate and source of the driving transistor D1. It can be known from the above analysis that the turn-on current of the light emitting device 04 is indeed unrelated with the threshold voltage of the driving transistor D1, so that the influence of the change of the threshold voltage of the driving transistor D1 on the light emitting luminance of the light emitting device 04 is eliminated, and the uniformity of the light emitting luminance of the light emitting device 04 better is enhanced well.

During the subsequent periods of time, the respective control signals are the same as the control signal during the period of time t4, and thus the light emitting state of the light emitting device 04 is maintained until the high level is again inputted to the initializing signal terminal Init in a period of time.

There is further provided in an embodiment of the present disclosure a method for driving a light emitting device in a pixel circuit. The pixel circuit includes a charging module, a driving module, an initializing module and the light emitting device. the method comprises following steps: in an initializing phase, initializing the driving module and the light emitting device by the initializing module under the control of an initialization signal terminal and a control signal terminal; in a writing phase, writing a data signal inputted from a data signal terminal by the charging module into a control terminal of the driving module under the control of a scanning signal terminal; and in a light emitting phase, loading a first reference signal inputted from the data signal terminal by the charging module to the control terminal of the driving module under the control of the scanning signal terminal, and connecting an output terminal of the driving module with an input terminal of the light emitting device by the initializing module under the control of the control signal terminal, so that the driving module drives the light emitting device to emit light Based on the same inventive concept, there is provided in an embodiment of the present disclosure an organic light emitting display panel, comprising the pixel circuits provided in the embodiments of the present disclosure. The organic light emitting display panel can be applicable to any product or components having a display function, such as a mobile phone, a tablet computer, a TV set, a display, a notebook computer, a digital photo frame, and a navigator and so on. Since the principle of solving the problem by the organic light emitting display panel is similar to that of the pixel circuit, the implementation of the organic light emitting display panel can be referred to the implementation of the pixel circuit. The repeated description is not provided herein.

There are provided in the embodiments of the present disclosure the pixel circuit, the method for driving the light emitting device and the organic light emitting display panel. The initializing module is added to the pixel circuit. In the initializing phase, the initializing module initializes the driving module and the light emitting device under the control of the initializing signal terminal and the control signal terminal; in the writing phase, the charging module writes the data signal inputted from the data signal terminal into the control terminal of the driving module under the control of the scanning signal terminal; and in the light emitting phase, the charging module loads the first reference signal inputted from the data signal terminal to the control terminal of the driving module under the control of the scanning signal terminal, and the initializing module connects the output terminal of the driving module with the input terminal of the light emitting device under the control of the control signal terminal so that the driving module drives the light emitting device to emit light, thereby realizing the function of normal light emitting of the light emitting device. Compared with the pixel circuit in the prior art, the pixel circuits provided in the embodiments of the present disclosure are capable of initializing the driving module and the light emitting device in the initializing phase, which eliminates the influence of the voltage difference in a previous phase on a subsequent phase, providing an compensating voltage and a driving voltage for the driving module in the writing phase, which avoids the influence of change of the threshold voltage on the light emitting luminance of the light emitting device, and raises uniformity of the light emitting luminance of the light emitting device, so that the quality of the display picture is ensured.

Obviously, those skilled in the art can make various alternations and modifications to the present disclosure without departing from the spirit and scope of the present disclosure. If these alternations and modifications of the present disclosure belong to the scope of the claims of the present disclosure as well as their equivalent technology, then the present disclosure intends to comprise these alternations and modifications.

The present application claims the priority of a Chinese patent application No. 201410503599.0 filed on Sep. 25, 2014. Herein, the content disclosed by the Chinese patent application is incorporated in full by reference as a part of the present disclosure.

What is claimed is:

1. A pixel circuit, comprising a light emitting device, and further comprising:

a charging module, whose input terminal is connected to a data signal terminal and control terminal is connected to a scanning signal terminal;

a driving module, whose input terminal is connected to a first reference signal terminal and control terminal is connected to an output terminal of the charging module; and an initializing module, wherein the initializing module comprises a reset unit and a control unit, a control terminal of the reset unit is connected to an initializing signal terminal, a first output terminal thereof is connected to the control terminal of the driving module and the output terminal of the charging module respectively, a first input terminal thereof is directly connected to an output terminal of the driving module and an output terminal of the control unit respectively, a second output terminal thereof is directly connected to an input terminal of the control unit and the input terminal of the light emitting device, and a second input terminal thereof is directly connected to the output terminal of the light emitting device and a second reference signal terminal, a control terminal of the control unit is connected to a control signal terminal;

wherein in an initializing phase, the initializing module is configured to initialize the driving module and the light emitting device under the control of the initializing signal terminal and the control signal terminal; in a writing phase, the charging module is configured to write a data signal inputted from the data signal terminal into the control terminal of the driving module under the control of the scanning signal terminal; and in a light emitting phase, the charging module is configured to load a first reference signal inputted from the data signal terminal to the control terminal of the driving module under the control of the scanning signal terminal, and the initializing module is configured to connect the output terminal of the driving module with the input terminal of the light emitting device under the control of the control signal terminal so that the driving module drives the light emitting device to emit light.

2. The pixel circuit according to claim 1, wherein the driving module comprises a driving transistor and a storage capacitor;

a gate of the driving transistor is connected to the output terminal of the charging module and the first output terminal of the initializing module, a source thereof is connected to the first reference signal terminal, and a drain thereof is connected to the first input terminal of the initializing module; and the storage capacitor is connected between the gate and the drain of the driving transistor.

3. The pixel circuit according to claim 2, wherein a control terminal of the reset unit is connected to the initializing signal terminal, a first output terminal thereof is connected to the output terminal of the charging module and the gate of the driving transistor respectively, a first input terminal thereof is connected to the drain of the driving transistor and an output terminal of the control unit respectively;

in the initializing phase, the reset unit connects the gate and the drain of the driving transistor under the control of the initialization signal terminal, and connects the input terminal of the light emitting device with the second reference signal terminal; the control unit connects the drain of the driving transistor with the second output terminal of the reset unit under the control of the control signal terminal; and in the light emitting phase, the control unit connects the drain of the driving transistor with the input terminal of the light emitting device under the control of the control signal terminal.

4. The pixel circuit according to claim 3, wherein the reset unit comprises a first switching transistor and a second switching transistor;

a gate of the first switching transistor is connected to the initializing signal terminal, a drain thereof is connected to the output terminal of the charging module and the control terminal of the driving transistor respectively, and a source thereof is connected to the drain of the driving transistor and the output terminal of the control unit respectively; and a gate of the second switching transistor is connected to the initializing signal terminal, a drain thereof is connected to the input terminal of the control unit and the input terminal of the light emitting device respectively, and a source thereof is connected to the output terminal of the light emitting device and the second reference signal terminal respectively.

5. The pixel circuit according to claim 4, wherein the charging module comprises a fourth switching transistor;

a gate of the fourth switching transistor is connected to the scanning signal terminal, a source thereof is connected to the data signal terminal, and a drain thereof is connected to the drain of the first switching transistor and the gate of the driving transistor respectively.

6. The pixel circuit according to claim 3, wherein the control unit comprises a third switching transistor;

a gate of the third switching transistor is connected to the control signal terminal, a drain thereof is connected to the drain of the driving transistor and the source of the first switching transistor respectively, and a source thereof is connected to the drain of the second switching transistor and the input terminal of the light emitting device.

7. The pixel circuit according to claim 6, wherein the charging module comprises a fourth switching transistor;

a gate of the fourth switching transistor is connected to the scanning signal terminal, a source thereof is connected to the data signal terminal, and a drain thereof is connected to the drain of the first switching transistor and the gate of the driving transistor respectively.

8. The pixel circuit according to claim 3, wherein the charging module comprises a fourth switching transistor;

a gate of the fourth switching transistor is connected to the scanning signal terminal, a source thereof is connected to the data signal terminal, and a drain thereof is connected to the drain of the first switching transistor and the gate of the driving transistor respectively.

9. The pixel circuit according to claim 2, wherein in the writing phase, the charging module is configured to write a threshold voltage of the driving transistor into the storage capacitor before writing the data signal into the control terminal of the driving module.

10. The pixel circuit according to claim 9, wherein the initializing module comprises a reset unit and a control unit;

a control terminal of the reset unit is connected to the initializing signal terminal, a first output terminal thereof is connected to the output terminal of the charging module and the gate of the driving transistor respectively, a first input terminal thereof is connected to the drain of the driving transistor and an output terminal of the control unit respectively, a second output terminal thereof is connected to an input terminal of the control terminal and the input terminal of the light emitting device, and a second input terminal thereof is connected to the output terminal of the light emitting device and the second reference signal terminal;

a control terminal of the control unit is connected to the control signal terminal;

in the initializing phase, the reset unit connects the gate and the drain of the driving transistor under the control of the initialization signal terminal, and connects the input terminal of the light emitting device with the second reference signal terminal; the control unit connects the drain of the driving transistor with the second output terminal of the reset unit under the control of the control signal terminal; and in the light emitting phase, the control unit connects the drain of the driving transistor with the input terminal of the light emitting device under the control of the control signal terminal.

11. The pixel circuit according to claim 10, wherein the reset unit comprises a first switching transistor and a second switching transistor;

a gate of the first switching transistor is connected to the initializing signal terminal, a drain thereof is connected to the output terminal of the charging module and the control terminal of the driving transistor respectively, and a source thereof is connected to the drain of the driving transistor and the output terminal of the control unit respectively; and a gate of the second switching transistor is connected to the initializing signal terminal, a drain thereof is connected to the input terminal of the control unit and the input terminal of the light emitting device respectively, and a source thereof is connected to the output terminal of the light emitting device and the second reference signal terminal respectively.

12. The pixel circuit according to claim 10, wherein the control unit comprises a third switching transistor;

a gate of the third switching transistor is connected to the control signal terminal, a drain thereof is connected to the drain of the driving transistor and the source of the first switching transistor respectively, and a source thereof is connected to the drain of the second switching transistor and the input terminal of the light emitting device.

13. An organic light emitting display panel, comprising the pixel circuit according to claim 1.

14. The organic light emitting display panel according to claim 13, wherein the driving module comprises a driving transistor and a storage capacitor;

a gate of the driving transistor is connected to the output terminal of the charging module and the first output terminal of the initializing module, a source thereof is connected to the first reference signal terminal, and a drain thereof is connected to the first input terminal of the initializing module; and the storage capacitor is connected between the gate and the drain of the driving transistor.

15. The organic light emitting display panel according to claim 14, wherein the initializing module comprises a reset unit and a control unit;

a control terminal of the reset unit is connected to the initializing signal terminal, a first output terminal thereof is connected to the output terminal of the charging module and the gate of the driving transistor respectively, a first input terminal thereof is connected to the drain of the driving transistor and an output terminal of the control unit respectively, a second output terminal thereof is connected to an input terminal of the control terminal and the input terminal of the light emitting device, and a second input terminal thereof is connected to the output terminal of the light emitting device and the second reference signal terminal;

a control terminal of the control unit is connected to the control signal terminal;

in the initializing phase, the reset unit connects the gate and the drain of the driving transistor under the control of the initialization signal terminal, and connects the input terminal of the light emitting device with the second reference signal terminal; the control unit connects the drain of the driving transistor with the second output terminal of the reset unit under the control of the control signal terminal; and in the light emitting phase, the control unit connects the drain of the driving transistor with the input terminal of the light emitting device under the control of the control signal terminal.

16. The organic light emitting display panel according to claim 15, wherein the reset unit comprises a first switching transistor and a second switching transistor;

a gate of the first switching transistor is connected to the initializing signal terminal, a drain thereof is connected to the output terminal of the charging module and the control terminal of the driving transistor respectively, and a source thereof is connected to the drain of the driving transistor and the output terminal of the control unit respectively; and a gate of the second switching transistor is connected to the initializing signal terminal, a drain thereof is connected to the input terminal of the control unit and the input terminal of the light emitting device respectively, and a source thereof is connected to the output terminal of the light emitting device and the second reference signal terminal respectively.

17. The organic light emitting display panel according to claim 15, wherein the control unit comprises a third switching transistor;

a gate of the third switching transistor is connected to the control signal terminal, a drain thereof is connected to the drain of the driving transistor and the source of the first switching transistor respectively, and a source thereof is connected to the drain of the second switching transistor and the input terminal of the light emitting device.

18. The organic light emitting display panel according to claim 17, wherein the charging module comprises a fourth switching transistor;

a gate of the fourth switching transistor is connected to the scanning signal terminal, a source thereof is connected to the data signal terminal, and a drain thereof is connected to the drain of the first switching transistor and the gate of the driving transistor respectively.

19. The organic light emitting display panel according to claim 14, wherein in the writing phase, the charging module is configured to write a threshold voltage of the driving transistor into the storage capacitor before writing the data signal into the control terminal of the driving module.

20. A method for driving a light emitting device in a pixel circuit including a charging module, a driving module, an initializing module and the light emitting device, wherein the initializing module comprises a reset unit and a control unit, a control terminal of the reset unit is connected to an initializing signal terminal, a first output terminal thereof is connected to the control terminal of the driving module and the output terminal of the charging module respectively, a first input terminal thereof is directly connected to an output terminal of the driving module and an output terminal of the control unit respectively, a second output terminal thereof is directly connected to an input terminal of the control unit and the input terminal of the light emitting device, and a second input terminal thereof is directly connected to the output terminal of the light emitting device and a second reference signal terminal, a control terminal of the control unit is connected to a control signal terminal, the method comprising following steps:

in an initializing phase, initializing the driving module and the light emitting device by the initializing module under the control of an initialization signal terminal and a control signal terminal;

in a writing phase, writing a data signal inputted from a data signal terminal by the charging module into a control terminal of the driving module under the control of a scanning signal terminal; and in a light emitting phase, loading a first reference signal inputted from the data signal terminal by the charging module to the control terminal of the driving module under the control of the scanning signal terminal, and connecting an output terminal of the driving module with an input terminal of the light emitting device by the initializing module under the control of the control signal terminal.

* * * * *